US006349852B1

(12) United States Patent
Ford

(10) Patent No.: US 6,349,852 B1
(45) Date of Patent: Feb. 26, 2002

(54) COLD BEVERAGE REFILL SYSTEM

(75) Inventor: David F Ford, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 09/564,249

(22) Filed: May 4, 2000

Related U.S. Application Data

(60) Provisional application No. 60/132,459, filed on May 4, 1999.

(51) Int. Cl.[7] ..... B67D 5/00

(52) U.S. Cl. ..... 222/56; 222/64; 222/129.2; 222/129.1; 222/142; 222/146.6; 222/137; 222/392; 222/62; 222/188; 222/342

(58) Field of Search ..... 222/1, 56, 64–66, 222/146.6, 129.1–129.4, 135, 138, 142, 148; 62/188, 342, 343; 137/392

(56) References Cited

U.S. PATENT DOCUMENTS

| | | | |
|---|---|---|---|
| 1,144,890 | A | 6/1915 | Calvert |
| 1,470,584 | A | 10/1923 | Kreutz |
| 1,602,686 | A | 10/1926 | Leet |
| 1,655,646 | A | 1/1928 | Da Costa |
| 1,745,716 | A | 2/1930 | Rynders |
| 2,437,216 | A | 3/1948 | Wilson et al. |
| 2,667,989 | A | 2/1954 | Unser |

(List continued on next page.)

FOREIGN PATENT DOCUMENTS

| | | | |
|---|---|---|---|
| AU | 141185 | | 5/1951 |
| BR | 8902462 | A | 11/1990 |
| DE | 2004391 | | 9/1970 |
| DE | 2459622 | | 9/1975 |
| DE | 2852109 | A | 6/1979 |
| EP | 0848925 | A | 6/1998 |
| EP | 0370150 | A1 | 11/1988 |
| ES | 92A02700 | | 11/1992 |
| FR | 2126102 | | 10/1972 |
| GB | 356796 | | 9/1931 |
| GB | 866680 | | 4/1961 |
| GB | 910188 | | 11/1962 |
| GB | 930080 | | 7/1963 |
| GB | 1044219 | | 9/1966 |
| GB | 1062263 | | 3/1967 |
| GB | 1067549 | | 5/1967 |
| GB | 1068956 | | 5/1967 |
| GB | 1157886 | | 7/1969 |
| GB | 1189370 | | 4/1970 |
| GB | 1300614 | | 12/1972 |
| GB | 2038953 | A | 7/1980 |
| GB | 2069458 | A | 8/1981 |
| GB | 2010105 | B | 5/1982 |
| GB | 2146620 | A | 4/1985 |
| SU | 1493228 | A | 7/1989 |

*Primary Examiner*—J. Casimer Jacyna
(74) *Attorney, Agent, or Firm*—Barnes & Thornburg

(57) ABSTRACT

A cold beverage dispensing system for chilling a beverage such that at least a portion of the beverage includes a frozen component. The system includes a beverage hopper or tank for retaining a quantity of beverage and a chilling assembly communicating with the beverage hopper for chilling the beverage. The system also includes a beverage detector having a conductive probe carried on and extending into the beverage hopper for detecting the condition of either the presence or absence of a beverage at a predetermined level in the beverage hopper and generating a refill control signal corresponding to the condition detected. A refill assembly communicates with the beverage hopper for controllably providing refill beverage to the beverage hopper. A controller is coupled to the refill assembly and the beverage detector for operating the refill assembly in response to the refill control signal to maintain the beverage in the beverage hopper at the predetermined level.

20 Claims, 4 Drawing Sheets

U.S. PATENT DOCUMENTS 2,673,005 A 3/1954 Brown
2,682,976 A 7/1954 Melikian et al.
2,708,533 A 5/1955 Nicholas
2,802,599 A 8/1957 Callahan et al.
2,972,434 A 2/1961 James
3,036,739 A 5/1962 Kamysz, Jr.
3,084,047 A 4/1963 Holstein et al.
3,084,613 A 4/1963 Maxson
3,108,718 A 10/1963 Seener
3,115,822 A 12/1963 Totten
3,123,256 A 3/1964 Smith et al.
3,132,771 A 5/1964 Truby
3,143,257 A 8/1964 Mumford
3,157,320 A 11/1964 Sherriffe
3,189,225 A 6/1965 Maxwell
3,194,437 A 7/1965 Toelke
3,196,627 A 7/1965 Swenson
RE25,859 E 9/1965 Thomas
3,236,270 A 2/1966 Stutz
3,253,741 A 5/1966 Russell et al.
3,266,670 A 8/1966 Brooks et al.
3,300,094 A 1/1967 Rockola
3,347,416 A 10/1967 Hamilton
3,359,748 A 12/1967 Booth
3,382,897 A 5/1968 Skiera et al.
3,385,569 A 5/1968 Bookout
3,394,847 A 7/1968 Garrard
3,403,825 A 10/1968 Modjeski
3,499,577 A 3/1970 Nilsson
3,521,791 A 7/1970 Freise et al.
3,528,587 A 9/1970 Popinski
3,536,925 A 10/1970 Schmidt
3,568,887 A 3/1971 Jacobs et al.
3,591,051 A 7/1971 Mitchell et al. ..... 222/56
3,599,655 A 8/1971 Fussell et al. ..... 137/81.5
3,632,019 A 1/1972 Harm ..... 222/56
3,640,433 A 2/1972 Rodth ..... 222/129.2
3,643,835 A 2/1972 Popinski
3,671,020 A 6/1972 Krup
3,697,052 A 10/1972 Andris
3,703,187 A 11/1972 Booth ..... 137/114
3,756,290 A 9/1973 Cleland et al. ..... 141/5
D229,897 S 1/1974 Martin
3,830,405 A 8/1974 Jaeger ..... 222/129.3
3,857,409 A 12/1974 Aubrey et al. ..... 137/604
3,863,810 A 2/1975 Hanson ..... 222/129.1
3,865,136 A 2/1975 Verschuur ..... 137/604
3,876,107 A 4/1975 Meindl et al.
3,915,341 A 10/1975 Brown ..... 222/67
3,934,758 A 1/1976 Kipp ..... 222/108
3,940,019 A 2/1976 Kross et al. ..... 222/30
3,942,688 A 3/1976 Pryor et al. ..... 222/108
3,955,713 A 5/1976 Hurley ..... 222/129.4
3,960,295 A 6/1976 Horak ..... 222/145
3,971,493 A 7/1976 Williams ..... 222/185
3,976,222 A 8/1976 Spagnolo ..... 222/70
3,978,778 A 9/1976 Roberts ..... 99/281
3,993,219 A 11/1976 Franzosi ..... 222/56
3,995,167 A 11/1976 Kulig ..... 250/577
4,006,888 A 2/1977 Emmons
4,008,832 A 2/1977 Rodth
4,015,749 A 4/1977 Arzberger et al.
4,030,634 A 6/1977 Osborn ..... 222/23
4,042,151 A 8/1977 Uttech
4,094,445 A 6/1978 Bevan ..... 222/1
4,116,128 A 9/1978 Lehmann et al.
4,116,246 A 9/1978 Franzen
4,141,316 A 2/1979 Grun ..... 118/303
4,154,368 A 5/1979 Gusmer et al. ..... 222/135
4,160,512 A 7/1979 Cleland
4,162,028 A 7/1979 Reichenberger ..... 222/129.4
4,165,821 A 8/1979 Martin et al.
4,182,363 A 1/1980 Fuller ..... 137/392
4,185,927 A 1/1980 Uttech
4,193,522 A 3/1980 Edelbach ..... 222/145
4,194,650 A 3/1980 Nottke et al. ..... 222/57
4,194,651 A 3/1980 Martin et al.
RE30,301 E 6/1980 Zygiel ..... 137/564.5
4,252,254 A 2/1981 Pryor ..... 222/67
4,280,401 A 7/1981 Cleland ..... 99/295
D260,095 S 8/1981 Bischoff et al. ..... D15/115
4,300,442 A 11/1981 Martin ..... 99/289
4,324,494 A 4/1982 Pryor et al.
4,357,861 A 11/1982 Di Girolamo
4,364,666 A 12/1982 Keyes ..... 366/142
4,366,920 A 1/1983 Greenfield, Jr. et al.
4,414,996 A 11/1983 Klepa ..... 137/101.27
4,417,671 A 11/1983 Kawasaki et al.
4,443,109 A 4/1984 Watts ..... 366/134
D274,114 S 6/1984 Cleland ..... D7/397
4,461,405 A 7/1984 Adamson ..... 222/201
4,469,137 A 9/1984 Cleland ..... 137/893
4,484,515 A 11/1984 Illy ..... 99/282
D276,785 S 12/1984 Cleland ..... D7/399
4,488,582 A 12/1984 Schilling
4,488,664 A 12/1984 Cleland ..... 222/56
4,493,249 A 1/1985 Stover
4,493,441 A 1/1985 Sedam et al.
4,522,059 A 6/1985 Rodde et al. ..... 73/223
4,538,636 A 9/1985 Cleland
4,544,084 A 10/1985 Cleland ..... 222/56
4,582,226 A 4/1986 Doak ..... 222/148
4,606,476 A 8/1986 Pocock et al. ..... 222/148
4,610,378 A 9/1986 Gross ..... 222/333
4,653,281 A 3/1987 Van Der Veer ..... 62/71
4,679,408 A 7/1987 Nelson ..... 62/390
4,684,332 A 8/1987 Hartley et al. ..... 417/397
4,703,870 A 11/1987 Sedam ..... 222/66
4,706,473 A 11/1987 Cipelietti ..... 62/342
4,718,579 A 1/1988 Brody et al. ..... 222/129.4
4,728,005 A 3/1988 Jacobs et al. ..... 222/64
4,736,593 A 4/1988 Williams ..... 62/136
4,750,645 A 6/1988 Wilson et al. ..... 222/145
4,765,513 A 8/1988 McMillin et al. ..... 222/129.1
4,795,061 A 1/1989 Peckjian ..... 222/66
4,850,515 A 7/1989 Cleland
4,869,072 A 9/1989 Sexton et al. ..... 62/136
4,900,158 A 2/1990 Ugolini ..... 366/143
4,922,725 A 5/1990 Rosmussen ..... 62/136
D315,493 S 3/1991 Cleland ..... D8/373
5,000,352 A 3/1991 Cleland ..... 222/129.2
5,186,096 A 2/1993 Willi ..... 99/282
5,191,999 A 3/1993 Cleland
5,289,846 A 3/1994 Elias et al. ..... 137/392
5,316,180 A 5/1994 Cleland ..... 222/56
5,340,080 A 8/1994 Cleland ..... 251/120
5,449,023 A 9/1995 Cleland et al. ..... 137/597
5,564,601 A 10/1996 Cleland et al. ..... 222/129
5,570,816 A 11/1996 LaBarbera, Jr. ..... 222/129.4
5,579,650 A 12/1996 Cleland et al. ..... 62/392
5,713,214 A * 2/1998 Ugolini ..... 62/188
5,743,108 A 4/1998 Cleland ..... 62/393
5,757,667 A 5/1998 Shannon et al. ..... 364/510
5,931,343 A 8/1999 Topar et al. ..... 222/56
5,975,357 A 11/1999 Topar ..... 222/56
5,980,969 A 11/1999 Mordini et al.
6,058,721 A 5/2000 Midden et al. ..... 62/136

* cited by examiner

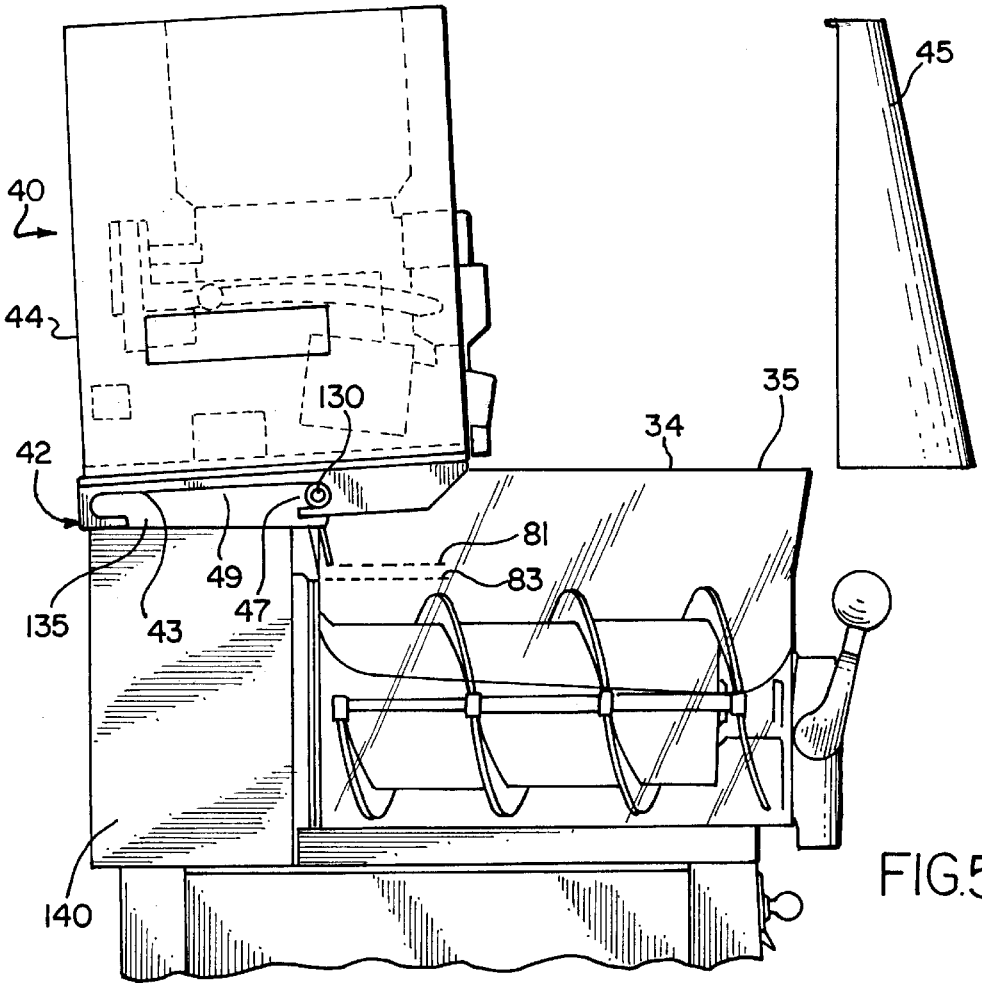
FIG.5
FIG.3
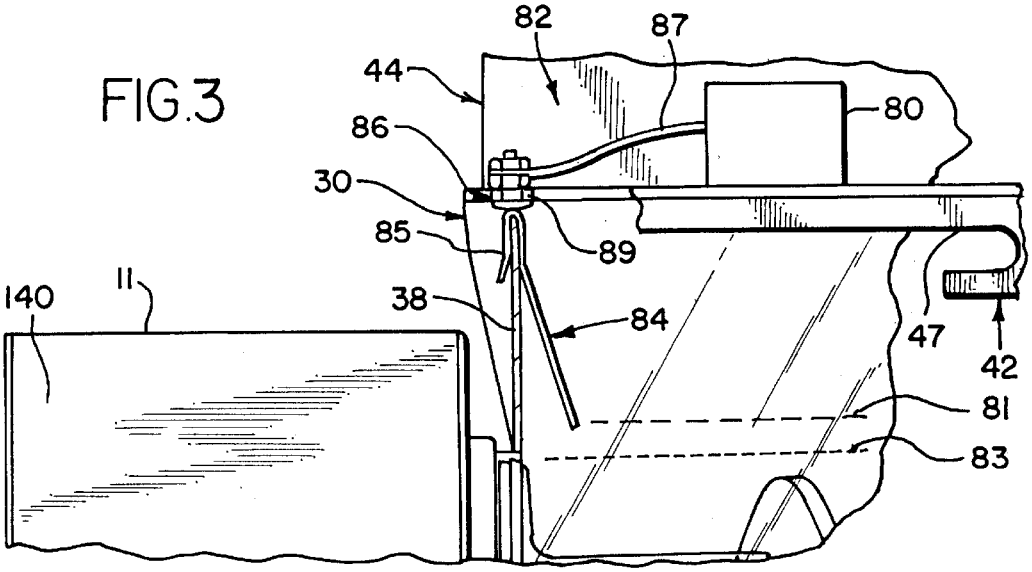

50
CONTROLLER
80
82
HOPPER
MOTOR
52
POWER
SUPPLY
90
91
PROBE
84
100
111
113
110
112
120
VALVE
95
MOTOR
70

COLD BEVERAGE REFILL SYSTEM

RELATED APPLICATION

This application is based on provisional U.S. application Ser. No. 60/132,459 filed May 4, 1999.

BACKGROUND

A variety of cold beverage dispensing systems have been designed to produce chilled beverages, such as frozen or slush beverages, chilled juice drinks, chilled alcoholic mixtures, milkshakes, etc. A typical cold beverage dispensing system may include a beverage hopper in the form of the tank or the like retaining a beverage in the form of a mixture of beverage concentrate and water, and a chilling structure for chilling the beverage to form a chilled beverage. The beverage concentrate may be in the form of a syrup or a powdered concentrate. Some form of blade or auger is provided which moves relative to the chilling portion to circulate the beverage along the chilling portion and within the beverage hopper. Circulation of the beverage along the chilling portion helps to reduce the temperature of the beverage.

Prior art cold beverage dispensing systems do not adequately address the difficulty of continuously dispensing quality chilled beverages. The degree of freezing and texture of a chilled beverage is important in providing a quality beverage. Similarly, the consistency of the freezing and texture is very important to customers in ordering drinks. Additionally, in the food service business, where efficiency is desirable if not necessary, it is important to be able to provide such beverages readily and continuously without having to encounter waiting time in waiting for the beverage to chill or freeze.

In the conventional refilling operation, for example, during each refill cycle, additional refill liquid is added to the beverage hopper when the supply of beverage within the beverage hopper has been reduced to a certain low level or depleted. Thus, each time a refill cycle is performed a relatively large volume of refill liquid needs to be chilled or frozen. This results in a long delay or waiting period before the next batch of chilled or frozen beverage is ready for dispensing or, alternatively, results in dispensing of an unsatisfactory beverage.

There are other shortcomings associated with prior art cold beverage dispensing systems. For example, conventional refilling operations are somewhat labor-intensive, inaccurate, and difficult to clean, increasing the operational costs of the cold drink system.

Additionally, because known prior art refilling systems are manual, such systems are susceptible to potential operator-related errors. For example, splashing of the beverage onto the system may occur during a refilling operation, leaving a sticky, residue on the machine. Moreover, an operator usually has to prepare the beverage by mixing an amount of beverage concentrate (e.g., syrup) with water. Thus, it is possible that beverage of an incorrect concentration may be prepared because of inaccurate measuring of the beverage concentrate and/or water. This, in turn, can adversely affect the taste of the beverage, result in inconsistent product quality, as well as affect the economic efficiency of the system, all of which are undesirable. Furthermore, the large quantities of beverage which must be lifted above and poured into the beverage hopper are heavy and unwieldy. Thus, the refilling operation can be difficult.

One prior art cold beverage dispensing system that is available which attempts to overcome some of the above-mentioned difficulties includes a refill tank coupled to the beverage hopper. The refill tank, which retains a quantity of premixed beverage or beverage mixture, is remote from the beverage hopper and is coupled to the beverage hopper by one or more hoses. When the supply of beverage or liquid in the beverage hopper has been depleted, the refill tank supplies the beverage hopper with additional beverage through the hoses. Such system, however, suffers from a number of deficiencies. In particular, the hoses do not drain effectively and, as a result, the liquid or beverage mixture stands in the hoses between refilling cycles. This can cause blockages in the hoses and possibly result in system shutdown. The beverage in the hoses contacts the entire surface area of the hoses and, therefore, may take on undesirable flavors, such as when the hose was previously used for a different flavor. As such, the flavor may be inconsistent and may adversely affect the taste of the chilled beverage.

Further drawbacks of such a prior art system are that the refill tank assembly requires considerable space, the system is awkward to set up, and is difficult to clean. Moreover, the system does not solve or avoid the problem of undue delay each time an additional batch of chilled beverage is prepared. Specifically, each time the beverage hopper is refilled, there still may be a considerable waiting period before the beverage is ready for dispensing, because of the time necessary to chill the beverage.

OBJECTS AND SUMMARY

Accordingly, it is a general object of the present invention to provide a cold beverage dispensing system, for chilling a liquid to produce a beverage having a frozen component, that includes an improved automatic refill assembly that desirably is effective and efficient.

A further object of the present invention is to provide such a cold beverage dispensing system having an automatic refill assembly and a beverage detector within a beverage hopper which enable the chilled beverage to be dispensed continuously without requiring a waiting time as servings of chilled beverage are dispensed.

A further object of the present invention is to provide such a cold beverage dispensing system that uses a powdered beverage concentrate and that includes a beverage refill concentrate hopper and a refill hopper detector for detecting either the presence or absence of beverage concentrate within the beverage refill concentrate hopper.

A still further object of the present invention is to provide a cold beverage dispensing system that includes a housing, a beverage hopper or tank, and a refill assembly that is secured to a housing and slides relative to the beverage hopper.

In accordance with these and other objects, the present invention provides a cold beverage dispensing system for chilling a beverage such that at least a portion of the beverage includes a frozen component. The system includes a beverage hopper or tank for retaining a quantity of beverage and a chilling assembly communicating with the beverage hopper for chilling the beverage. The system also includes a beverage detector having a conductive probe carried on and extending into the beverage hopper for detecting the condition of either the presence or absence of a beverage at a predetermined level in the beverage hopper and generating a refill control signal corresponding to the condition detected. A refill assembly communicates with the beverage hopper for controllably providing refill beverage to the beverage hopper. A controller is coupled to the refill assembly and the beverage detector for operating the refill assembly in response to the refill control signal to maintain the beverage in the beverage hopper at the predetermined level.

The refill assembly is adapted to produce the refill beverage by mixing with water a beverage concentrate, such as a powdered concentrate or syrup. In the preferred embodiment, the concentrate is a powdered concentrate and the refill assembly includes a beverage refill concentrate hopper for retaining a quantity of powdered concentrate and a mixing assembly including a water inlet and a mixing device. The mixing assembly communicates with the dispenser hopper for receiving a quantity of powdered concentrate therefrom and for mixing the quantity of powdered concentrate with a quantity of water dispensed from the water inlet which is mixed by the mixing device. The mixing assembly communicates with the beverage hopper for dispensing the mixture of water and powdered concentrate into the beverage hopper desirably in a thoroughly dissolved and mixed liquid form.

A cold beverage dispensing system in accordance with a preferred embodiment of the present invention provides many advantages. For example, because of the beverage detector, quality chilled beverages can be supplied readily and continuously. The beverage detector functions to ensure that the predetermined beverage level within the tank remains constant and to control the degree of freezing, texture and consistency of the dispensed chilled beverage. The beverage detector is a novel aspect of the present invention and a significant improvement over the prior art.

The cold beverage dispensing system is effective and efficient and easy to set up and convenient to clean and maintain. Due to its construction, it also reduces the likelihood of contamination of the chilled beverage with old refill beverage.

BRIEF DESCRIPTION OF THE DRAWINGS

The present invention will now be described by way of example with reference to the accompanying drawings in which:

FIG. 3 is an enlarged side elevational view of a portion of a control assembly according to the invention;

FIG. 5 is a side elevational view of a cold beverage dispensing system according to the invention with the refill assembly moved to the rear of the system to facilitate cleaning and maintenance.

DETAILED DESCRIPTION

Figure 1:
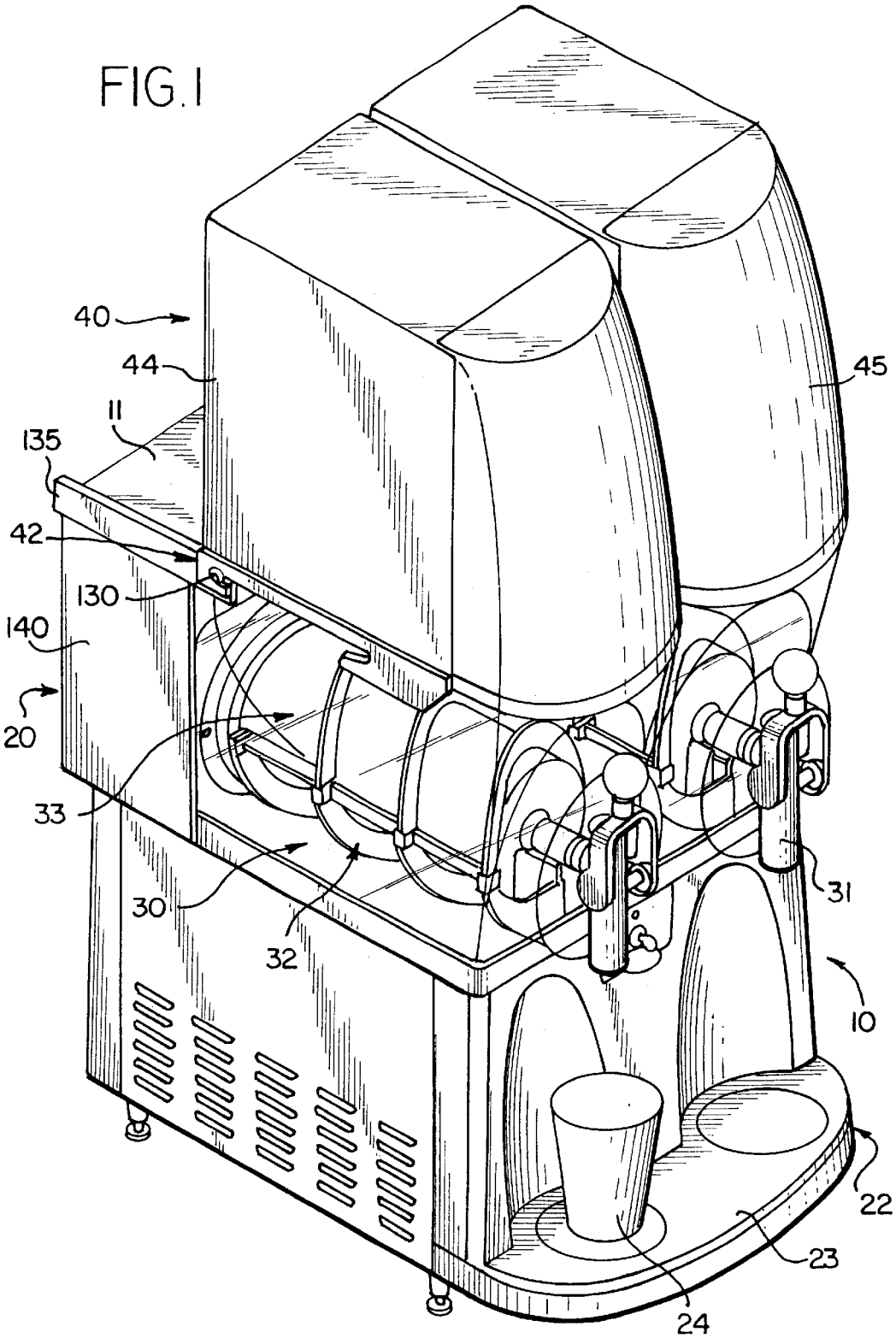
FIG. 1 is a perspective view of a cold beverage dispensing system according to the invention.

A cold beverage dispensing system 10 in accordance with a preferred embodiment of the invention, which is illustrated in FIG. 1, includes a housing or base 20 and at least one beverage hopper 30. Each beverage hopper 30 is positioned on the housing 20 and retains a quantity of liquid or beverage ready for dispensing. In the illustrated embodiment two beverage hoppers 30 are shown; it will be apparent to those skilled in the art, however, that it may be desirable to provide a single beverage hopper 30 as well as three or more beverage hoppers 30.

The cold beverage dispensing system 10 also includes a refill assembly 40 associated with each beverage hopper 30 for controllably dispensing refill beverage into the beverage hopper 30. Desirably, each refill assembly 40 is secured to the housing 20, is positioned above its associated beverage hopper 30, and is slidable relative to the beverage hopper 30.

Control system 50 (FIG. 4) also forms part of the cold drink system 10. The control system 50 is coupled to the refill assembly 40 to control production of and the supply of refill beverage to the beverage hoppers 30 and to maintain the beverage at a predetermined level as explained below.

The illustrated housing 20 includes a dispensing area 22 for receiving a beverage dispensed from a beverage hopper 30. The dispensing area 22 may include a platform 23 on which a cup or receptacle 24 may be placed for receiving the beverage from the beverage hopper 30. In this regard, a dispensing nozzle 31 may be coupled to each beverage hopper 30 for dispensing beverage into a receptacle 24. The dispensing nozzle 31 preferably extends from a corresponding beverage hopper 30 so that it is positioned above the platform 23.

As illustrated, each beverage hopper 30 preferably includes an auger assembly 32 for mixing and circulating the beverage retained within the beverage hopper 30. The auger assembly 32 desirably comprises a generally helical auger blade adapted for rotation about a generally horizontal axis. It will be apparent to those skilled in the art, however, that a different auger or mixing assembly 32 could be used without departing from the spirit of the invention. For example, a paddle structure could be used. It should be noted that the present invention also envisions a cold drink system 10 in which no auger or mixing assembly 32 is positioned within each beverage hopper 30 and movement of a chilled beverage is accomplished using other means. The refill assembly 40 of the present invention will find utility with any of these cold beverage dispensing systems as well as others.

In the preferred embodiment as illustrated, each beverage hopper 30 communicates with a chilling assembly 33 for chilling the beverage within the beverage hopper 30. The chilling assembly 33 and auger assembly 32 are both retained within a corresponding beverage hopper 30. It is also preferred that the chilling assembly 33 be positioned proximate the auger assembly 32.

As described in U.S. Pat. Nos. 5,918,768 and 5,927,553, which are incorporated herein by reference, the housing 20 also includes an auger drive motor for driving the auger assembly 32 via a shaft and a coolant system for providing the chilling assembly with a chilling effect.

As stated above, the refill assembly 40 desirably is positioned above, and slidable with respect to, a corresponding beverage hopper 30. Advantageously, the refill assembly 40 supplies refill beverage directly into the beverage hopper 30. This in turn reduces the time necessary for supplying refill beverage to the beverage hopper 30 and thus the time for a refilling cycle. Additionally, such positioning of the refill assembly 40 obviates the use of hoses and similar coupling devices for delivering beverage to the refill assembly, and thereby avoids the problems associated with the use of such coupling devices to connect a refill assembly to a beverage hopper. Positioning of the refill assembly 40 above the beverage hopper 30 minimizes the overall space requirements or "foot print" of the cold drink system 10. In this regard, it is well known that in the typical environment (e.g., restaurants) in which cold drink systems 10 are used, space is at a premium.

In a preferred embodiment of the present invention, the refill assembly 40 is positioned on top of the beverage hopper 30 partially covering a mouth 35 of the beverage hopper 30. The rear of the refill assembly 40 is aligned with the rear of the beverage hopper 30, leaving a front portion 34 of the beverage hopper 30 uncovered. The refill assembly 40 includes guide rails 42 to facilitate sliding of the refill assembly 40 relative to the beverage hopper 30. In particular, first and second rails 42 are provided, positioned on first and second opposite sides respectively of the refill assembly 40. The guide rails 42 preferably substantially center the refill assembly 40 over and suspend it above the mouth 35 of its corresponding beverage hopper 30.

Figure 2:
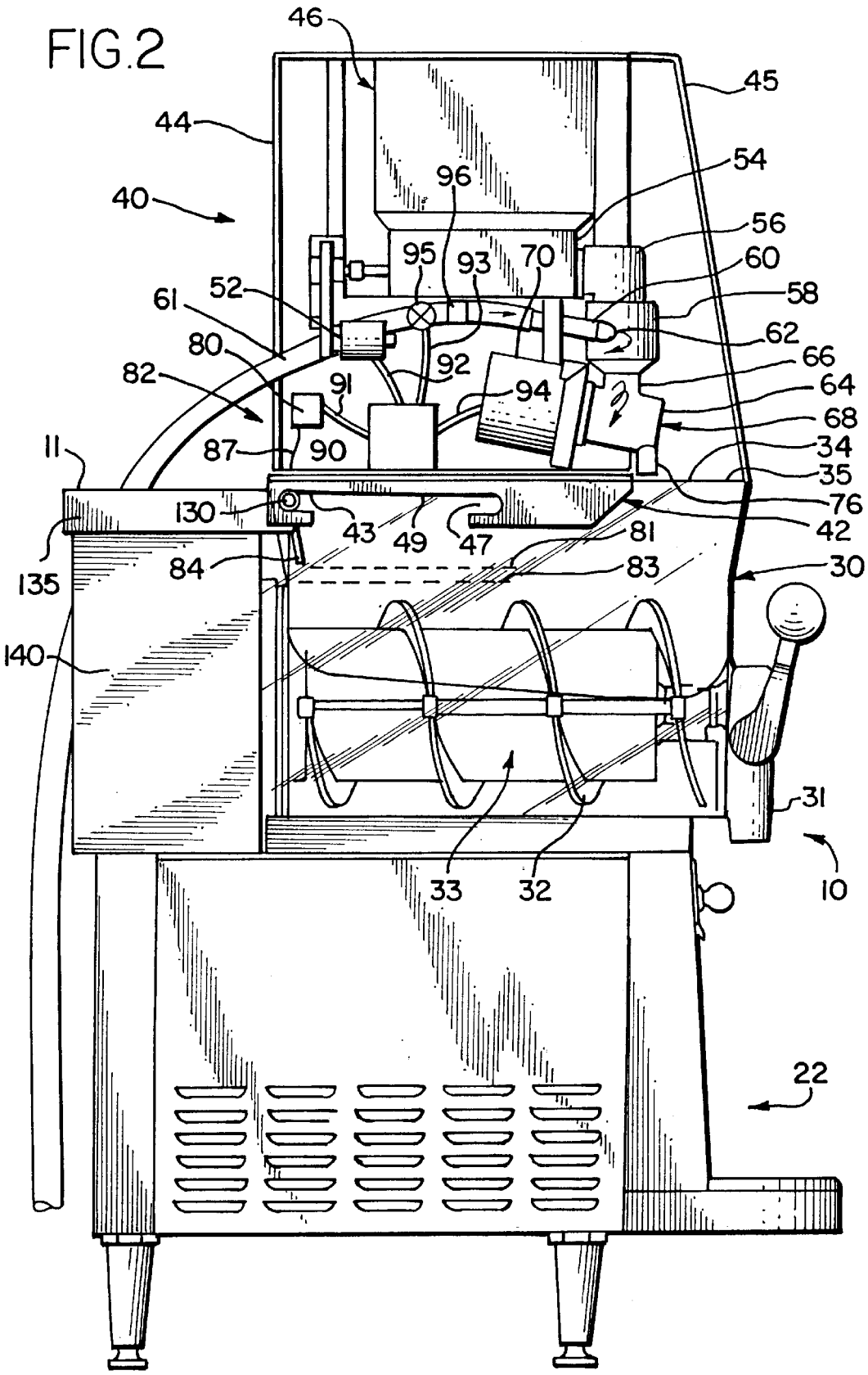
FIG. 2 is side elevational, partial cross-sectional view of a refill assembly according to the invention.

As shown in FIG. 2, the guide rails 42 are connected to the base of a refill assembly housing 44. The refill assembly housing 44 retains components for producing and supplying the additional beverage and protects them from the external environment. A front cover or hood 45 is also provided for covering and restricting access to the refill assembly components. The front cover or hood 45 attaches to the front face and encloses the front of the refill housing 44. Additionally, a lower portion of the front cover 45 encloses the mouth 35 of the beverage hopper 30.

As shown in FIG. 5 and described in greater detail hereinbelow, the refill assembly 40 is moved backwardly from its position covering the mouth 35 of the beverage hopper 30. When moved backwardly, the refill assembly 40 tilts upwardly to fully open the beverage hopper 30. As such, the beverage hopper can be removed from the housing of the apparatus for thorough cleaning. It should be noted, however, that the refill assembly 40 is still engaged with and carried on the base 20. This is an improvement over the prior art which required removing and assembly from the housing and placing it on another surface. It will be appreciated that removal from the assembly can subject the refill assembly to unnecessary contamination or damage. As such, the displaceable refill assembly is retained on the base yet fully disengages the beverage hopper for removal of the hopper is a substantial improvement over the prior art.

As stated above, the refill assembly 40 of the present invention not only supplies refill beverage to the beverage hopper 30, but also controllably and automatically produces the refill beverage it supplies. Advantageously, this means that operator-related errors associated with the preparation of additional or refill beverage are avoided, e.g., preparation of a beverage of the incorrect concentration. In the preferred embodiment of the present invention, the refill assembly 40 produces additional beverage by mixing a quantity of dry powdered concentrate with water.

The refill assembly 40 includes beverage concentrate dispenser hopper, desirably in the form of powdered concentrate dispenser hopper 46, retained within the housing 44. The powdered concentrate dispenser hopper 46 retains a quantity of dry powder beverage concentrate. The powdered concentrate dispenser hopper 46 communicates with a stirring and dispensing mechanism (not illustrated) for stirring the powdered concentrate within the powdered concentrate dispenser hopper 46 and dispensing powder therefrom. The stirring and dispensing mechanism includes a hopper motor 52. The construction of the stirring and dispensing mechanism is substantially the same as that described in U.S. Pat. Nos. 5,918,768 and 5,927,553, to which reference is again invited.

As shown in FIG. 2, the illustrated refill assembly 40 also includes a first passage 58 which communicates with the powdered concentrate dispenser hopper 46. The first passage 58 receives a quantity of powdered concentrate dispensed from the powdered concentrate dispenser hopper 46 through an outlet 54 and an elbow 56. A water inlet 60 dispenses water into the first passage 58 when the powdered concentrate is dispensed from the hopper. The water inlet 60 couples the refill assembly 40 to a water source, preferably with a positive pressure. In this regard, a hose 61 may be provided for coupling the water inlet 60 to a water source. The water inlet 60 includes a tangential entry aperture 62. The tangential entry aperture 62 introduces water in a tangential orientation to produce and promote swirling of the water in the first passage 58. The swirling action promotes dissolving of the powdered concentrate in the water and the cleansing of the first passage surfaces at the completion of the refill cycle.

The first passage 58 communicates with a second passage 64. The combined powder and water from the first passage 58 drain into the second passage 64 through a coupling 66. A blending mechanism 68 (not illustrated) is retained within the second passage 64 to mechanically combine the powder and water. The blending mechanism 68 includes a motor 70 (FIG. 2) and a mixing blade substantially as shown and taught in the above-referenced applications. Agitation quickly, thoroughly mixes the powder in water combination to assure complete dissolving of the powder in the water. The resultant liquid beverage refill mixture is dispensed from the second passage 64 through the dispensing outlet 76 and into the beverage hopper 30.

In providing a quality chilled beverage, it is also desirable to assure complete dissolving of the powder in the water. The powder is in a granular form including sugar and flavor components. Of course, the flavor components may be carried in the granular sugar. Nevertheless, there is a granular component to the powder which typically does not fully dissolve upon the initial introduction to the water. As such, the blending mechanism 68 mechanically combines the water and the granular powder.

In this regard, complete dissolving of the powder in the water is assured. The complete dissolving of the powder in the water prevents damage to the mixing assembly and chilling assembly. In this regard, if the granular powder concentrate is not fully dissolved in the water upon introduction to the beverage hopper, the grains may cause abrasion as they are moved by the helical auger forwardly from the rear of the beverage hopper towards the front along the outside surface of the chilling assembly. Such abrasion will unnecessarily wear the auger relative to the chilling assembly and the chilling assembly relative to the auger. This wear may result in a gap of undesirable dimension forming between the auger and the chilling assembly thereby reducing the effectiveness of the system. This is especially important since the present system chills beverages to a temperature range near to and slightly above or at the freezing point of the beverage. As such, if the powder concentrate is not fully dissolved in the water prior to entry into the beverage hopper, it is unlikely, due to the reduced temperature, that further dissolving will occur. There are a number of prior art devices which do not produce a chilled or frozen beverage. Rather, they provide a cooled fully liquid beverage. In these types of devices, when a user adds a large volume of mixture to the beverage hopper, the agitating action will further disperse and assure dissolving of any undissolved particulars. These types of devices do not use the auger and chilling assembly arrangement and therefore do not encounter the wear problems which the present invention overcomes. Rather, because of the cooled but not chilled nature of the beverage retained in the prior art devices, further dissolving of the powder in the beverage will occur.

As an additional consideration, the present invention must reduce the temperature of refill beverage quickly so as not to reduce the frozen texture of the remaining portion of the beverage in the beverage hopper. In this regard, the use of the blending mechanism 68 assures that a fully dissolved beverage refill portion is introduced into the beverage hopper.

Thus, advantageously, in the present invention, additional beverage mixture is dispensed directly from the refill assembly 40 into the beverage hopper 30 without the use of hoses or other awkward connection means. Accordingly, delivery of additional beverage mixture is quick, efficient and simple. Additionally, the gravity-feed construction of the dispensing outlet 76 and its short length prevent accumulation of beverage mixture therein and thus mixing with the residue of a previous dispensing cycle.

The manner of preparing the refill beverage mixture in the present invention also provides advantages. Specifically, the use of a powdered concentrate to form the refill beverage, rather than a non-powdered liquid concentrate such as syrup, reduces the space requirements of the system 10 and makes the system 10 easier to use. The space requirements are reduced because only a relatively small volume of powder is required to produce a relatively large volume of beverage. Accordingly, only a relatively small volume of powder needs to be stored in the refill assembly 40 to produce enough beverage for many refill cycles. Additionally, the powdered concentrate is relatively light. This facilitates handling of the powdered concentrate, when the powdered concentrate hopper 46 is refilled. Furthermore, use of a powdered concentrate helps increase the operational efficiency of the cold drink system 10. In particular, more refill cycles can be performed than in prior art systems before it becomes necessary to supply additional powdered concentrate (i.e., beverage mix) to the refill assembly 40.

Production and supplying of refill beverage from the refill assembly 40 to the beverage hopper 30 is regulated by a controller 80. The controller 80 controls the refill assembly 40 so that a desired predetermined level of beverage is maintained in the beverage hopper 30. This predetermined level is schematically shown by the dashed line 81 in FIG. 2. Specifically, the controller 80 detects when the beverage in the beverage hopper 30 is not present at the desired level 81 in which case it activates the refill assembly 40 in response to supply additional beverage to the beverage hopper 30. A beverage detector 82 is provided for indicating to the controller 80 when the beverage is not present at the desired level 81. Dashed line 83, which is intended to schematically represent any level below the probe 84, illustrates beverage not present at level 81. Inasmuch as any level below level 81 will be detected by probe 84, the distance between 81 and 83 is exaggerated in the drawings simply for illustrative purposes.

In view of The National Sanitation Foundation Rules, it is undesirable to position a probe on the housing in any manner in which the probe would provide surfaces or recesses in the "food area". In this regard, The National Sanitation Foundation has standards which require ease of cleaning or removal for cleaning, without using tools, of parts which are in the "food area". As such, any refill device used with a frozen beverage type of cold drink system as taught herein must be easily cleaned within these standards. Additionally, a problem is created by the need to have a beverage detector which allows the housing to slide relative to the beverage hopper, as will be described in greater detail hereinbelow. As such, prior art techniques of hanging a probe directly from the housing are completely unusable in the present invention.

The controller 80 preferably comprises a beverage circuit and is retained within the refill assembly housing 44. The beverage detector 82 includes a probe 84. As best illustrated in FIG. 3, the probe 84 is carried on a rear wall 38 of beverage hopper 30 and extends a predetermined distance into the beverage hopper 30. The probe 84 preferably includes an upper portion 85 to facilitate clipping or hooking of the probe 84 onto the rear wall 38 of the beverage hopper 30. The probe is also easily removable from the beverage hopper wall for purposes of cleaning in accordance with The National Sanitation Foundation guidelines. In a preferred embodiment, the probe 84 comprises a conductivity probe and the controller 80 is adapted to detect the conductivity of the probe 84. Specifically, the probe 84 is conductive when beverage contacts the probe 84 and is not conductive when the beverage ceases to contact the probe 84 or, in other words, when the end of the probe 84 is exposed to air.

As stated above, it is preferred that the controller 80 be retained within the refill assembly housing 44 and the probe 84 be carried on and extend into the beverage hopper 30. In this regard, a contact element 86 is provided for coupling the controller 80 to the probe 84. As illustrated in FIG. 3, the contact element 86 is carried by the refill assembly housing 44 and coupled to the controller 80 by an electrical lead 87. The contact element 86 preferably extends through the base of refill assembly housing to couple the controller 80 to the probe 84. It is also preferred that the contact element 86 be biased into engagement with the beverage detector 82. In this regard, a spring 89 may be provided for biasing the contact element 86 into engagement with the probe 84. As shown, the contact extends a nominal distance from the bottom of the base of the refill assembly. The contact does not interfere with the sliding movement of the assembly relative to the beverage hopper. The contact provides conductive coupling of the controller to the probe and provides easily cleanable surfaces which will satisfy The National Sanitation Foundation standards.

In a preferred embodiment, the controller 80 detects through the contact element 86 whether the probe 84 is conductive, and hence whether beverage is present at the desired predetermined level 81. Specifically, when the beverage in the beverage hopper 30 ceases to contact the probe 84, the probe 84 ceases to be conductive. The controller 80 detects the lack of conductivity through the contact element 86 and in response activates the refill assembly 40 to supply refill beverage to the beverage hopper 30. If desired, a momentary time-delay mechanism in any suitable form may be included before activating the refill assembly to ensure that the lack of conductivity is not caused by momentary turbulence in the liquid.

The activation of the refill assembly 40 will now be described with reference to FIGS. 2 and 4. When the controller 80 determines through the contact element 86 that the beverage is no longer present at the desired predetermined level 81, the controller 80 activates a power supply 90. The controller 80 is coupled to the power supply 90 via a control line 91. Activation of the power supply 90 opens a water inlet valve 95 so that pressurized water flows into the mixing chamber 58. In accordance with well known practices, a flow controller 96 is provided on the inlet line to regulate the flow of water and maintain flow of water at a predetermined rate. In a preferred embodiment of the present invention, the water inlet valve 95 comprises a solenoid valve. As shown in FIG. 2, the power supply 90 is coupled to the inlet valve 95 by a control line 93.

Simultaneously, the power supply 90 also activates the powdered concentrate hopper motor 52 and mixing motor 70 so that a preselected quantity of dry powdered beverage concentrate is dispensed and mixed with a preselected quantity of the incoming water. Preferably, the powdered concentrate hopper motor 52 comprises a DC gear motor. As illustrated in FIG. 2, the power supply 90 is coupled to the powdered concentrate hopper motor and motor 70 by control lines 92 and 94, respectively.

Refill beverage mixture is prepared and dispensed to the beverage hopper 30 until the beverage in the beverage hopper 30 contacts the probe 84 and causes it to be conductive. When the controller 80 detects the conductivity of the probe 84, it deactivates the power supply 90. This in turn causes the inlet valve 95, powdered concentrate hopper motor 52, and motor 70 to be shut off, thereby completing the refill cycle.

Advantageously, in the present invention, the controller 80 is adapted to control the refill assembly 40 so that additional beverage is supplied to the beverage hopper 30 as beverage is dispensed therefrom. Specifically, each time a quantity of beverage is dispensed from the beverage hopper 30, additional or refill beverage is supplied substantially simultaneously to the beverage hopper 30. By refilling the beverage hopper 30 in this manner, only relatively small amounts of refill beverage are added to the beverage hopper 30 each time a refill operation is performed. Because only relatively small amounts of refill beverage are added, it takes only a nominal amount of time to freeze the additional or refill beverage to the desired temperature. Minimizing the refreeze time in the chilled or frozen drink system of the present invention is very important. In a prior art cold beverage dispensing system which dispenses cold beverages which has no frozen component, the concentration or flavor as well as the temperature are important. However, in cold beverage dispensing systems, the type in which the beverage includes a frozen component, the degree of freezing or texture is also very important, and is a characteristic which customer come to expect. The incremental addition of refill beverage is important in maintaining the texture since the small quantity of refill beverage is nominal in relation to the entire quantity in the beverage hopper and is quickly integrated and frozen to the desired temperature. Accordingly, the present invention essentially eliminates the considerable waiting period associated with the refilling operation in the prior art.

Figure 4:
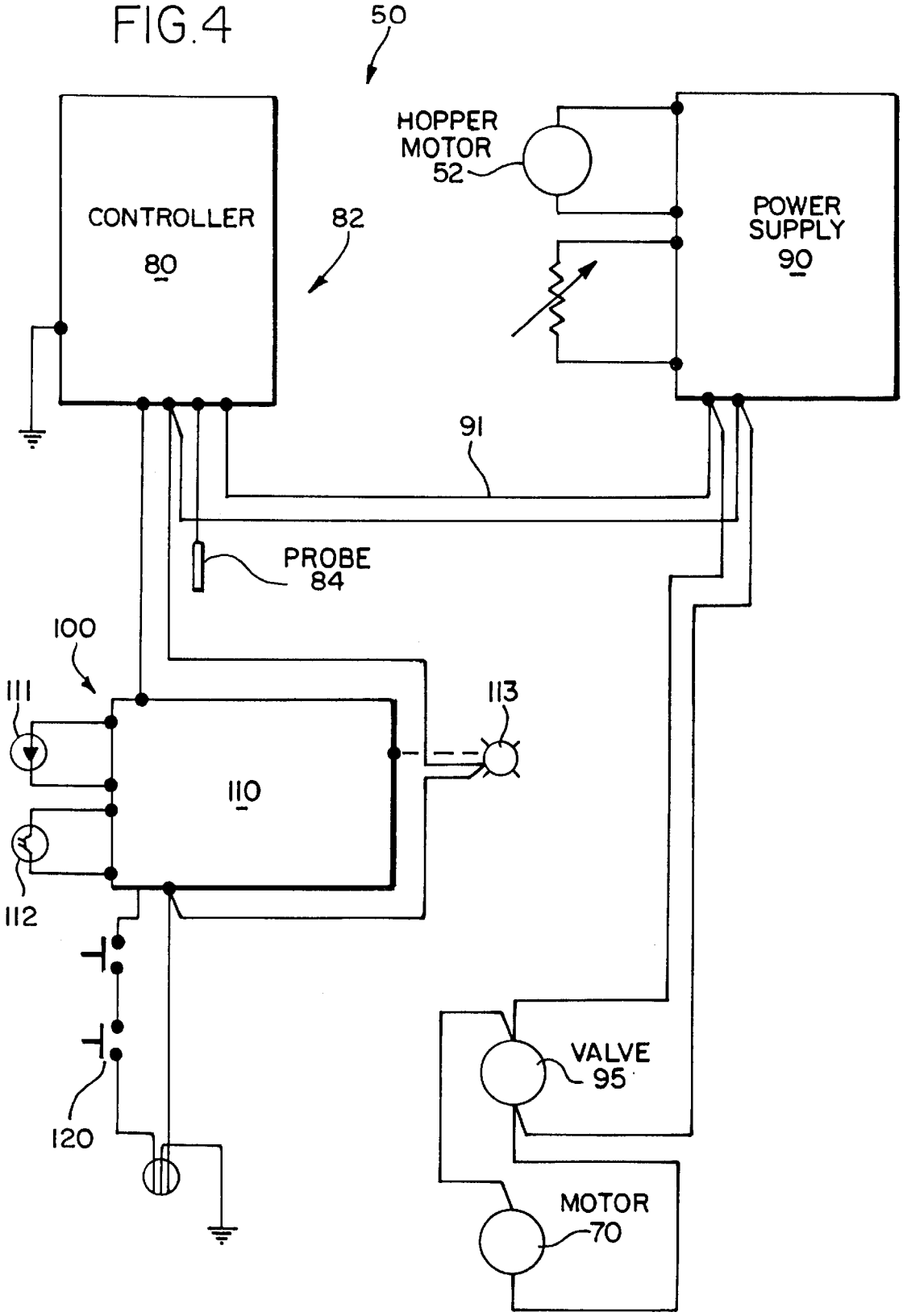
FIG. 4 is a schematic diagram of the control assembly according to the invention.

As shown in FIG. 4, a control assembly 100 is also provided for ensuring that the additional liquid mixture supplied to the beverage hopper 30 is of a desired composition. Specifically, a hopper level detector circuit or a sensor 110 is provided for determining whether there is a sufficient quantity of powdered concentrate in the powdered concentrate hopper 46 is available to produce refill beverage of the desired composition. In the present invention, the sensor 110 preferably comprises an emitter 111 and a detector 112 mounted on opposite sides of the powdered concentrate hopper 46. When there is a sufficient level of powdered concentrate within the hopper 46, the powdered concentrate prevents the light beam from the emitter 111 from reaching the detector 112 mounted on the opposite side of the powdered concentrate hopper 46. When the powdered concentrate is not at a predetermined level in the hopper 46, the detector 112 then senses the light from the emitter 111 and causes the refill assembly 49 to be shut off. Alternatively, the sensor 110 may also cause either a visual signal, such as a low hopper indicator light 113 to be lit or an audio signal to be produced, indicating to an operator that the hopper 46 needs to be refilled.

The sensor 110 of the present invention provides a particular advantage and solves a problem unrecognized by the prior art, when used in conjunction with a cold beverage dispensing system for producing a partially frozen beverage. In such a cold beverage dispensing system, the sensor 110 of the present invention prevents water only or water with insufficient powdered beverage to be dispensed to the beverage hopper 30. Such a situation is undesirable because it could result in formation of a hard ice, which would be difficult to shave off the chilling assembly, could possibly lock-up the auger mechanism, put stress on the drive motor, and/or otherwise damage the cold beverage dispensing system. The prior art cold beverage dispensing systems which serve liquid, unfrozen beverages could not appreciate the importance of this improvement. While this control system would impact the flavor of the drink in the prior art system, the prior art system would not have been damaged in the absence of such a system.

As discussed above, the refill assembly 40 is positioned above the beverage hopper 30 on a pair of guide rails 42. In the present invention the rails 42 are adapted to guide the assembly 40 as it is slidably moved relative to the beverage hopper 30. Advantageously, this allows the refill assembly 40 to move horizontally forward and backward to provide access to or covering of the beverage hopper 30. This greatly facilitates the cleaning of the beverage hopper 30 in place, as well as removal of the beverage hopper from the housing. As is well known in the art, the beverage hopper 30 must be cleaned periodically for sanitation reasons. Because the refill assembly 40 can be slid to cover or reveal at least a portion of the mouth of the beverage hopper 30, access to the interior of the beverage hopper 30 is easily provided and cleaning of the beverage hopper 30 is simplified. Also, the rails 42, advantageously retain the assembly on the system 10 to prevent casual or accidental removal thus reducing the possibility for damage of the assembly.

It should be noted that although in a preferred embodiment the refill assembly 40 is displaced relative to the beverage hopper 30 by a sliding action, other displacement assemblies could be used. For example, the refill assembly 40 could be tilted back from or lifted off of the beverage hopper 30 without the use of the rails 42.

It will be apparent that as the refill assembly 40 is moved to expose the mouth of the beverage hopper 30, the contact element 86 will be moved out of engagement with probe 84 and electrical contact between the controller 80 and probe 84 will be broken. It will be recalled that the controller 80 is adapted to activate the refill assembly 40 whenever a break in electrical contact with the probe 84 or a lack of conductivity is sensed. Accordingly, a switch 120 (FIG. 4) is provided for deactivating the refill assembly 40 as it is moved away from the beverage hopper 30. The switch 120 preferably comprises a proximity switch. The switch 120 automatically shuts down the refill assembly 40, whenever the refill assembly is moved from the beverage hopper 30 to prevent undesired refilling of the beverage hopper 30.

In a preferred embodiment, movement of the refill assembly 40 on the beverage hopper 30 is facilitated by a pair of cam followers 130 and a pair of support rails 135. The support rails 135 are positioned on a housing 140 in which the auger drive motor is retained. In particular, one support rail 135 is positioned on a first side of the housing 140 and the other support rail 135 is positioned on a second opposite side of the housing 140. The support rails 135 are positioned behind the beverage hopper 30 and in alignment with the sides of the beverage hopper 30. The support rails 135 guide movement of the refill assembly 40 when it is moved rearwardly away from the beverage hopper 30 toward the housing 140.

The cam followers 130, which are positioned adjacent front portions of the support rails 135, are adapted to engage the rails 42. Specifically, each rail 42 includes a notch 43 which fits around a cam follower 130 when the refill assembly 40 is in its operative position—i.e., aligned with the rear of the beverage hopper 30. Engagement of the notch 43 with the cam follower 130 helps retain the refill assembly 40 in its operative position on the beverage hopper 30; i.e., engagement of the notch 43 with the cam follower 130 prevents forward movement of the refill assembly 40 on the beverage hopper 30. Engagement of the cam followers 130 with the rails 42 also facilitates movement of the refill assembly 40 onto and off of the beverage hopper 30, as will be discussed shortly.

In use, when it is desired to clean the beverage hopper 30, first the front cover 45 is removed. It will be recalled that the front cover 45 resists rearward movement of the refill assembly 40 and helps retain the refill assembly 40 in a position substantially aligned with the rear of the beverage hopper 30. Once the front cover 45 is removed, the refill assembly 40 may be slid rearwardly away from the beverage hopper 30 toward the rear 11 of the cold drink system 10. In particular, the rails 42 will slide along the followers 130 and on the support rails 42 to effect rearward movement of the refill assembly 40. As the refill assembly 40 is moved rearwardly, the cam followers 130 will engage a sloped portion 49 (see FIG. 5) of the rails 42. Engagement of the cam followers 130 with the sloped portion 49 of the rails 42 will cause the refill assembly 40 to be lifted up and tilted back off the beverage hopper 30.

As the refill assembly 40 is moved further rearwardly, it continues to tilt away from the beverage hopper 30. Eventually the center of gravity of the refill assembly 40 will become located to the rear of the cam followers 130. In the illustrated embodiment of the present invention, this occurs just before the refill assembly 40 is slid completely to the rear 11 of the cold drink system 10 and as the cam followers 130 engage front notches 47 of the rails 42. Location of the center of gravity behind the cam followers 130 causes the refill assembly 40 to pivot back on the cam followers 130 and onto the housing part 140 as it is moved rearwardly. Thus, in the present invention, in its furthest rearward position the refill assembly 40 will be tipped back or tilted away from the beverage hopper 30 thereby providing access for cleaning. It should be noted that in this tilted back position engagement of the cam followers 130 with the front notches 47 prevents further rearward movement of the refill assembly 40 (see FIG. 5).

Advantageously, the present invention also facilitates cleaning of the powdered concentrate dispenser hopper 46 and refill assembly 40. In particular, removal of the front cover 45 will provide access to the powdered concentrate dispenser hopper 46 and the other components of the refill assembly 40.

The tilting of the hopper in the rearward position as described above is also advantageous since it completely disengages the refill assembly from the mouth of the hopper. In this regard, all of the weight is carried by the cam followers 130 with a portion of the refill assembly 40, perhaps, carried on the rear housing portion 140. This is advantageous since the refill assembly 40 is maintained in engagement on the base while allowing removal of the beverage hopper 30 from the base for thorough cleaning. In this regard, the cam followers 30 are attached to the base independently of the beverage hopper so that the structure retaining and at least partially supporting the refill assembly 40 is not connected to the beverage hopper 30. By carrying the refill assembly 40 on the base independent of the beverage hopper, a single operator can remove the beverage hopper for cleaning and replace it without complication, without tools, without assistance from another operator and without risk of damage to the apparatus. After cleaning, when the beverage hopper is replaced on the base, the refill assembly 40 is merely moved forwardly to its original position at least partially over the beverage hopper.

The operation of the present invention should be apparent from the foregoing, but it will be now briefly described. The cold beverage dispensing system 10 is operated by supplying a beverage in the beverage hopper 30. The front cover 45 is attached to the refill assembly 40 and the beverage hopper 30 and then the system 10 is activated. Activation of the system 10 will result in rotation of the auger assembly 32 within the beverage hopper 30 and initiation of a cooling cycle. Cooling is provided by the chilling assembly 33. As an external surface of the chilling assembly 33 begins to cool, the temperature of the beverage is decreased. The auger assembly 32 revolves to mix the beverage within the beverage hopper and increase the rate of cooling. The auger assembly 32 includes a helically configured blade which is positioned in close proximity to the external surface of the chilling assembly 33 which removes a thin sheet of frozen material from the chilling assembly 33 as it is rotated relative thereto. When a desired beverage temperature having a desired degree of frozen beverage component is attained, beverage may be dispensed through the dispensing nozzle 31 into a container 24 positioned there below.

As beverage is dispensed, when the beverage in the beverage hopper 30 ceases to contact the probe 84, the probe 84 will cease to be conductive. The controller 80 will detect the lack of conductivity through the contact element 86 and activate the refill assembly 40. Specifically, the power supply 90 will be turned on. This, in turn, will cause the water inlet valve 95 to be opened so that water flows into the first passage 58. Simultaneously, the powdered concentrate hopper motor 52 will be activated so that a predetermined quantity or flow rate of powdered beverage concentrate is dispensed into the first passage 58. The combined water and powdered beverage concentrate then pass through the second passage 64 where it is mixed further and then through the outlet 76 and into the beverage hopper 30. The additional beverage mixture is produced and supplied as beverage is dispensed. Additional beverage is dispensed until the beverage in the beverage hopper 30 contacts the probe 84.

Thus, an improved cold drink system 10 has been described. The cold beverage dispensing system 10 of the present invention includes the improved automatic refill assembly 40. The refill assembly 40 of the present invention is efficient in construction, and easy to set up and convenient to maintain. Only two external hookups are necessary—i.e., a water hook-up and electrical hook-up. The refill assembly 40 is positioned above the beverage hopper. The refill assembly 40 simplifies and increases the efficiency of a refilling operation. No operator intervention is required and the additional or refill beverage is dispensed directly into the beverage hopper 30. The refill assembly 40 also prevents contamination of the chilled beverage with old refill beverage, since there are no hoses or similar coupling devices in which refill beverage can accumulate. Moreover, the cold beverage dispensing system 10 of the present invention facilitates cleaning operations. By simple removal of the cover 45, access to the interior of the refill assembly 40 is provided. Likewise, by simply displacing the refill assembly 40 rearwardly, access to the beverage hopper 30 is provided. Furthermore, the cold beverage dispensing system 10 of the present invention also provides an improved control system 50 which is simple in construction and overcomes deficiencies of the prior art. For example, the control system 50 eliminates the waiting period associated with preparation of additional chilled beverage.

What is claimed is:

1. A beverage dispensing system comprising:

base structure;

at least one support attached to said base structure;

a beverage hopper for retaining a quantity of said beverage, said beverage hopper being retained on said base structure;

a dispensing device operatively coupled with said beverage hopper for dispensing beverage therefrom;

a refill assembly communicating with said beverage hopper for controllably providing refill beverage to said beverage hopper;

at least one guide attached to said refill assembly, said at least one guide being operatively couplable with said at least one support for maintaining said refill assembly on said base structure when said refill assembly is displaced relative to said beverage hopper.

2. The beverage dispensing system of claim 1 wherein the base structure includes a housing positioned rearward of the beverage hopper.

3. The beverage dispensing system of claim 2 wherein the support comprises a pair of support rails mounted to the housing.

4. The beverage dispensing system of claim 2 wherein said at least one guide is operatively couplable with said at least one support for maintaining said refill assembly on said housing.

5. The beverage dispensing system of claim 1 wherein the support comprises a pair of support rails.

6. The beverage dispensing system of claim 5 wherein the support includes a pair of cam followers associated with the pair of support rails, the cam followers engaging the at least one guide.

7. The beverage dispensing system of claim 6 wherein there are two guides, each cam follower engaging a respective guide.

8. The beverage dispensing system of claim 7 wherein each guide comprises a guide rail.

9. The beverage dispensing system of claim 1 wherein the refill assembly is tiltable relative to the beverage hopper between an open position and a closed position.

10. The beverage dispensing system of claim 1 wherein there are two guides.

11. The beverage dispensing system of claim 10 wherein each guide comprises a guide rail.

12. The beverage dispensing system of claim 11 wherein the support includes a cam follower, the guides being engaged with the cam follower.

13. The beverage dispensing system of claim 12 wherein the refill assembly is tiltable relative to the beverage hopper between an open position and a closed position.

14. The beverage dispensing system of claim 1 wherein the refill assembly is movable relative to the beverage hopper between forward and rearward positions.

15. The beverage dispensing system of claim 14 wherein the refill assembly is tiltable relative to the beverage hopper between an open position and a closed position.

16. The beverage dispensing system of claim 14 wherein the support includes a cam follower engaged with the guide.

17. The beverage dispensing system of claim 16 wherein the guide defines a pair of notches, the cam follower is received within one notch when the refill assembly is in its forward position and the cam follower is received within the other notch when the refill assembly is in its rearward position.

18. The beverage dispensing unit of claim 17 wherein there are two guides and two cam followers.

19. The beverage dispensing system of claim 18 wherein the support includes a pair of support rails engaged with the cam followers.

20. The beverage dispensing system of claim 19 wherein each guide comprises a guide rail.

* * * * *